US009739094B2

(12) United States Patent
Moreno, II et al.

(10) Patent No.: US 9,739,094 B2
(45) Date of Patent: Aug. 22, 2017

(54) REAMER BLADES EXHIBITING AT LEAST ONE OF ENHANCED GAGE CUTTING ELEMENT BACKRAKES AND EXPOSURES AND REAMERS SO EQUIPPED

(71) Applicant: Baker Hughes Incorporated, Houston, TX (US)

(72) Inventors: Mario Moreno, II, Spring, TX (US); James D. Enterline, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 660 days.

(21) Appl. No.: 14/020,353

(22) Filed: Sep. 6, 2013

(65) Prior Publication Data

US 2015/0068813 A1 Mar. 12, 2015

(51) Int. Cl.
*E21B 10/32* (2006.01)
*E21B 10/26* (2006.01)
*E21B 17/10* (2006.01)

(52) U.S. Cl.
CPC ..... *E21B 10/32* (2013.01); *E21B 10/26* (2013.01); *E21B 17/1092* (2013.01)

(58) Field of Classification Search
CPC ..... E21B 10/26; E21B 10/28; E21B 10/30; E21B 10/32; E21B 10/322; E21B 10/325; E21B 10/327; E21B 10/34; E21B 10/345; E21B 17/1092
See application file for complete search history.

(56) References Cited

U.S. PATENT DOCUMENTS

| | | | |
|---|---|---|---|
| 2,136,518 | A | 11/1938 | Nixon |
| 2,532,418 | A | 12/1950 | Pate |
| 2,638,988 | A | 5/1953 | Williams |
| 2,874,784 | A | 2/1959 | Baker et al. |
| 3,083,765 | A | 4/1963 | Kammerer |
| 3,126,065 | A | 3/1964 | Kammerer |
| 3,171,502 | A | 3/1965 | Kammerer |

(Continued)

FOREIGN PATENT DOCUMENTS

| | | |
|---|---|---|
| EP | 1044314 | 10/2000 |

OTHER PUBLICATIONS

International Preliminary Report on Patentability for International Application No. PCT/US2014/054258, dated Mar. 8, 2016, 13 pages.

(Continued)

*Primary Examiner* — David Andrews
*Assistant Examiner* — Kristyn Hall
(74) *Attorney, Agent, or Firm* — TraskBritt

(57) ABSTRACT

A downhole tool configured to enlarge a borehole may include at least one blade extending laterally from a central portion of the tool. The one or more blades may each include a gage portion, and cutting elements comprising substantially circular cutting faces may be affixed to each of the one or more blades. Each of the one or more cutting elements may include a cutting edge comprising an arcuate peripheral cutting face portion for contacting the borehole. Cutting faces of at least one cutting element on a gage portion of the at least one blade may exhibit a cutting face back rake angle greater than a cutting face back rake angle of cutting elements on at least one other portion of the at least one blade.

20 Claims, 4 Drawing Sheets

(56) References Cited

U.S. PATENT DOCUMENTS

| | | | |
|---|---|---|---|
| 3,283,834 | A | 11/1966 | Kammerer |
| 3,289,760 | A | 12/1966 | Kammerer |
| 3,351,137 | A | 11/1967 | Schulz et al. |
| 4,403,659 | A | 9/1983 | Upchurch |
| 4,693,328 | A | 9/1987 | Furse et al. |
| 4,893,678 | A | 1/1990 | Stokley et al. |
| 5,139,098 | A | 8/1992 | Blake |
| 5,443,129 | A | 8/1995 | Bailey et al. |
| 5,788,000 | A | 8/1998 | Maury et al. |
| 5,862,870 | A | 1/1999 | Hutchinson et al. |
| 5,967,247 | A | 10/1999 | Pessier |
| 6,006,845 | A | 12/1999 | Illerhaus et al. |
| RE36,817 | E | 8/2000 | Pastusek |
| 6,123,160 | A | 9/2000 | Tibbitts |
| 6,131,675 | A | 10/2000 | Anderson |
| 6,173,795 | B1 | 1/2001 | McGarian et al. |
| 6,289,999 | B1 | 9/2001 | Dewey et al. |
| 6,349,780 | B1 | 2/2002 | Beuershausen |
| 6,378,632 | B1 | 4/2002 | Dewey et al. |
| 6,668,949 | B1 | 12/2003 | Rives |
| 6,681,860 | B1 | 1/2004 | Yokley et al. |
| 6,702,020 | B2 | 3/2004 | Zachman et al. |
| 6,732,817 | B2 | 5/2004 | Dewey et al. |
| 7,048,078 | B2 | 5/2006 | Dewey et al. |
| 7,314,099 | B2 | 1/2008 | Dewey et al. |
| 2004/0159468 | A1* | 8/2004 | Hoffmaster ..... E21B 10/32 175/267 |
| 2008/0190670 | A1 | 8/2008 | Welch et al. |
| 2010/0224414 | A1 | 9/2010 | Radford et al. |
| 2011/0005841 | A1 | 1/2011 | Wood et al. |
| 2011/0287924 | A1* | 11/2011 | Stevens ..... B22D 19/06 501/87 |
| 2012/0205163 | A1 | 8/2012 | Azar et al. |
| 2013/0133949 | A1 | 5/2013 | Xu et al. |

OTHER PUBLICATIONS

International Search Report for International Application No. PCT/US2014/054258, dated Dec. 16, 2014, three pages.

Written Opinin of the International Searching Authority for International Application No. PCT/US2014/054258, dated Dec. 16, 2014, 12 pages.

* cited by examiner

REAMER BLADES EXHIBITING AT LEAST ONE OF ENHANCED GAGE CUTTING ELEMENT BACKRAKES AND EXPOSURES AND REAMERS SO EQUIPPED

FIELD

The disclosure relates generally to reamers for enlarging boreholes in subterranean formations. More specifically, the disclosed embodiments relate to reamer blades for expandable reamers and fixed-blade reamers carrying superabrasive cutting elements having substantially circular cutting faces at least one of oriented and exposed to reduce or eliminate the need to alter an as-produced geometry of the superabrasive cutting elements.

BACKGROUND

Reamers are typically employed for enlarging boreholes in subterranean formations. In drilling oil, gas, and geothermal wells, casing is usually installed and cemented to, among other things, prevent the well bore walls from caving into the borehole while providing requisite shoring for subsequent drilling operation to achieve greater well depths. Casing is also installed to isolate different formations, to prevent cross flow of formation fluids, and to enable control of formation fluids and pressure as the borehole is drilled. To increase the depth of a previously drilled borehole, new casing, or liner is extended below the initial casing. The diameter of any subsequent sections of the well may be reduced because the drill bit and any further casing or liner must pass through the interior of the initial casing. Such reductions in the borehole diameter may limit the production flow rate of oil and gas through the borehole. Accordingly, a borehole may be enlarged in diameter below the initial casing to a diameter greater than an outer diameter of the initial casing prior to installing additional casing or liner to minimize any reduction in interior diameter of a production-ready (i.e., cased or lined and cemented) borehole and enable better production flow rates of hydrocarbons through the borehole.

One conventional approach used to enlarge a subterranean borehole includes the use of an expandable reamer, alone or above a pilot bit sized to pass through the initial casing. Expandable reamers may include blades carrying cutting elements and that are pivotably or slidingly affixed to a tubular body and actuated between a retracted position and an expanded position. Another conventional approach used to enlarge a subterranean borehole includes employing a bottom-hole assembly comprising a fixed blade reamer, commonly termed a "reamer wing," alone or above a pilot drill bit. The reamer may include a number of blades of differing radial extent to enable the reamer to pass eccentrically through the initial casing and subsequently, when the reamer is rotated about a central axis, enlarge the borehole below the initial casing.

In both approaches, superabrasive cutting elements such as those comprising polycrystalline diamond compacts (PDCs) may be used to engage and degrade the formation. Such cutting elements, when employed on the gage of a reamer blade, may require machining, such as grinding, after the cutting elements are affixed to a reamer blade to establish a cutting diameter of the reamer, to create a smooth wall of the borehole after the borehole is enlarged by other, more distal (with regard to the extent of the borehole) superabrasive cutting elements, and to reduce reactive torque on the reamer due to contact of the gage cutting elements with the borehole wall. For example, a linear edge may be ground into a side of a superabrasive table of an otherwise cylindrical cutting element. Such machining may require an additional step in production, and thus may increase the time and cost associated with manufacturing a reaming tool. Furthermore, superabrasive cutting elements, such as those comprising PDCs, exhibit internal residual compressive and tensile stresses attributable to the high pressure, high temperature process employed to form the PDC, to attach the PDC to a supporting substrate, or both, particularly, for example, at an interface between a polycrystalline diamond table of a PDC and a supporting tungsten carbide substrate. Machining can alter the magnitude and type of stresses resident in the as-formed PDC as well as symmetrical residual stress distribution, potentially compromising the integrity of the cutting superabrasive element, leading to early failure by mechanisms such as spalling or delamination of the PDC from the supporting substrate.

BRIEF SUMMARY

In one embodiment, a downhole tool configured to enlarge a borehole may comprise at least one blade extending laterally from a central portion of the tool, and the at least one blade may comprise a gage portion. Cutting elements having substantially circular cutting faces may be affixed to the at least one blade, and each of the cutting elements may comprise a cutting edge for contacting the borehole. Cutting edges of at least one cutting element located on the gage portion may be defined substantially by an arcuate portion of a cutting face periphery. The at least one cutting element located on the gage portion may exhibit a cutting face back rake angle greater than a back rake angle of cutting faces of cutting elements on at least one other portion of the at least one blade.

In another embodiment, a reamer blade may comprise a gage portion and cutting elements having substantially circular cutting faces affixed to the at least one blade. Each of the cutting elements may comprise a cutting edge for contacting the borehole. Cutting edges of at least one cutting element located on the gage portion may be defined substantially by an arcuate portion of a cutting face periphery. The at least one cutting element located on the gage portion may exhibit a cutting face back rake angle greater than a back rake angle of cutting faces of cutting elements on at least one other portion of the at least one blade.

BRIEF DESCRIPTION OF THE DRAWINGS

While the disclosure concludes with claims particularly pointing out and distinctly claiming specific embodiments, various features and advantages of embodiments of the disclosure may be more readily ascertained from the following description when read in conjunction with the accompanying drawings, in which:

DETAILED DESCRIPTION

The illustrations presented herein are not meant to be actual views of any particular reamer tool or component thereof, but are merely idealized representations employed to describe illustrative embodiments. Thus, the drawings are not necessarily to scale.

Figure 1:
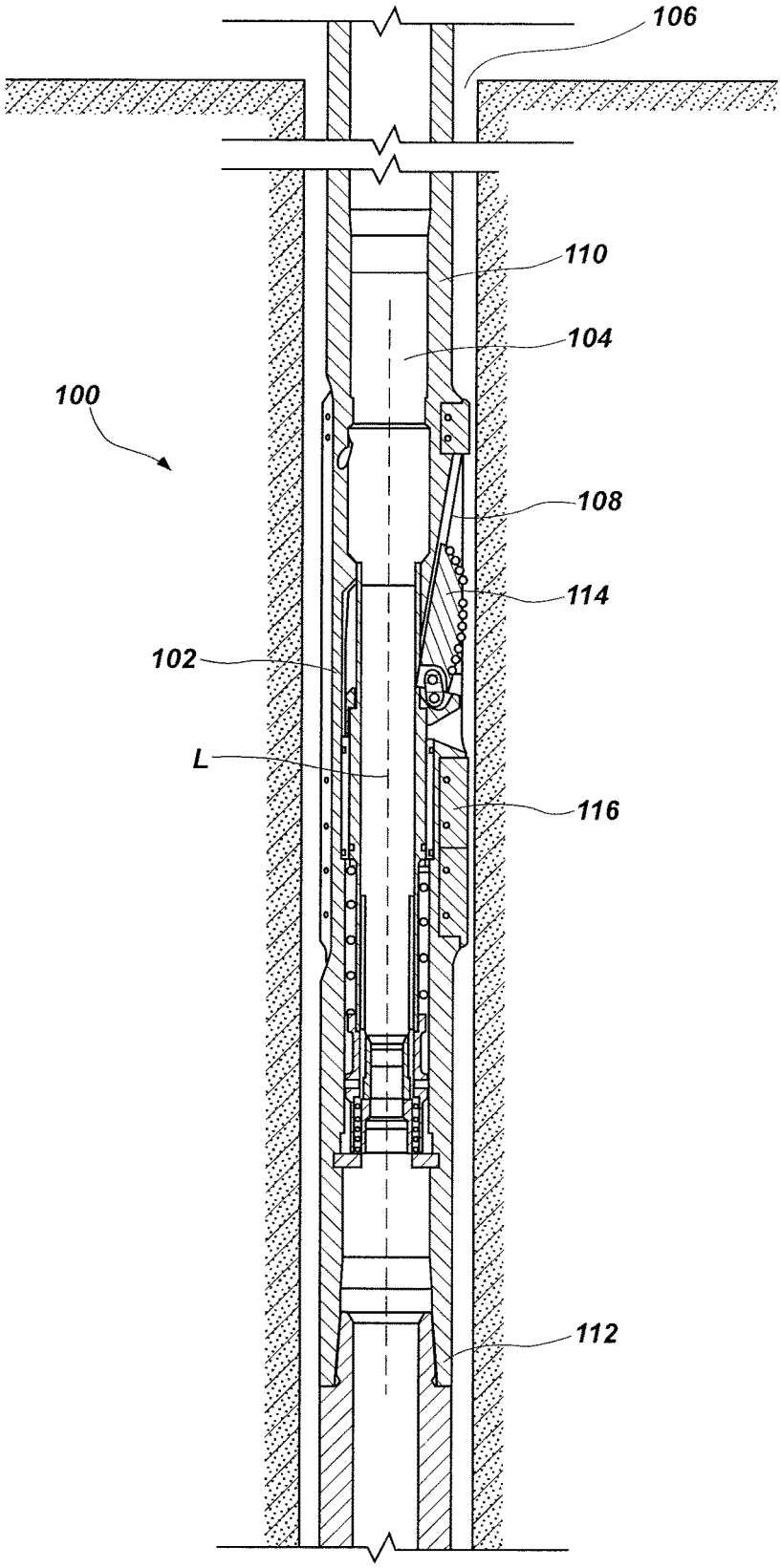
FIG. 1 is a cross-sectional view of an embodiment of an expandable reamer in a subterranean formation.

Referring to FIG. 1, a cross-sectional view of an expandable reamer 100 in a borehole 106 in a subterranean formation is shown. The expandable reamer 100 may comprise a housing 102 having a longitudinal axis L and defining a central bore 104 extending through the housing 102. The housing 102 may comprise a generally cylindrical tubular structure with an upper end 110 and a lower end 112. The lower end 112 of the housing 102 may include a connection portion (e.g., a threaded box or pin member) for connecting the lower end 112 to another section of a drill string or another component of a bottom-hole assembly (BHA), such as, for example, a drill collar or collars carrying a pilot drill bit for drilling a borehole. Similarly, the upper end 110 of the housing 102 may include a connection portion (e.g., a threaded box or pin member) for connecting the upper end 110 to another section of a drill string or another component of a bottom-hole assembly (BHA).

A plurality of blades 114 (only one blade 114 is visible, and other blades are not within the plane of FIG. 1) is circumferentially spaced around the housing 102 and is carried by the housing 102 between the upper end 110 and the lower end 112. The blades 114 are shown in an initial, retracted position within the housing 102 of the expandable reamer 100, but are configured selectively to extend responsive to application of hydraulic pressure into an extended position when actuated and return to the retracted position when de-actuated. The expandable reamer 100 may be configured to engage the walls of a subterranean formation defining the borehole 106 with the blades 114 to remove formation material when the blades 114 are in the extended position, and to disengage from the walls of the subterranean formation when the blades 114 are in the retracted position. The blades 114 may be configured to move upward (i.e., towards a proximal end of the drill string above the surface of the subterranean formation) and radially outward from the longitudinal axis L along a track or guide 108 to engage walls of the borehole 106. While the expandable reamer 100 shown includes three blades 114, the expandable reamer 100 may include any number of blades 114, such as, for example, one, two, four, or greater than four blades, in alternative embodiments. Moreover, though the blades 114 shown are symmetrically circumferentially positioned around the longitudinal axis L of the housing 102 at the same longitudinal position between the upper and lower ends 110 and 112, the blades may also be positioned circumferentially asymmetrically around the longitudinal axis L, at different longitudinal positions between the upper and lower ends 110 and 112, or both in alternative embodiments.

The expandable reamer 100 may optionally include a plurality of stabilizers 116 extending radially outwardly from the housing 102. Such stabilizers 116 may center the expandable reamer 100 in the borehole while tripping into position through a casing or liner string and while drilling and reaming the borehole by contacting and sliding against the wall of the borehole. In other embodiments, the expandable reamer 100 may lack such stabilizers 116. In such embodiments, the housing 102 may comprise a larger outer diameter in the longitudinal portion where the stabilizers are shown in FIG. 1 to provide a similar centering function as provided by the stabilizers. The stabilizers 116 may stop or limit the extending motion of the blades 114, determining the extent to which the blades 114 extend to engage a borehole. The stabilizers 116 may optionally be configured for removal and replacement by a technician, particularly in the field, allowing the extent to which the blades 114 extend to engage the borehole to be selectively increased or decreased to a preselected and determined degree.

Figure 2A:
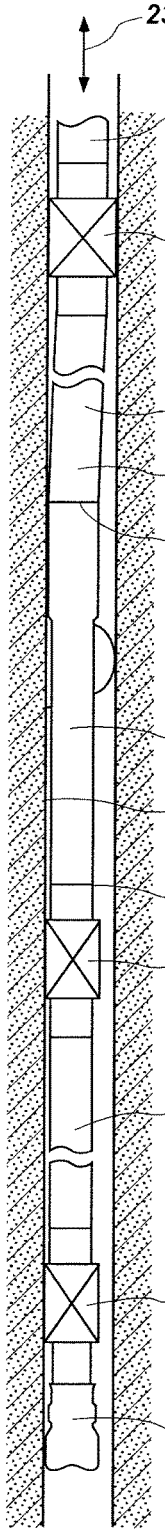
FIGS. 2A through 2C are schematic partial sectional elevations of an embodiment of a bottom-hole assembly including a reamer wing in a subterranean formation.
Figure 2B:
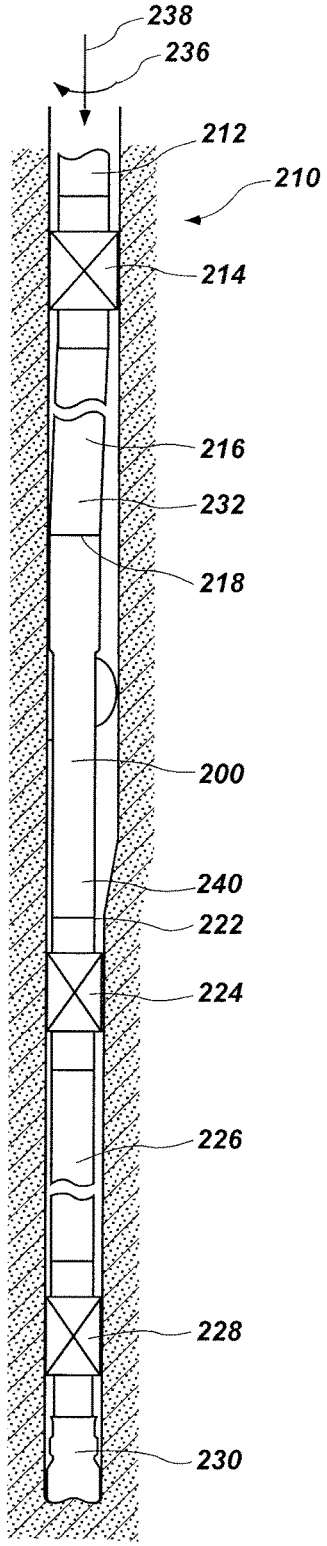
Figure 2C:
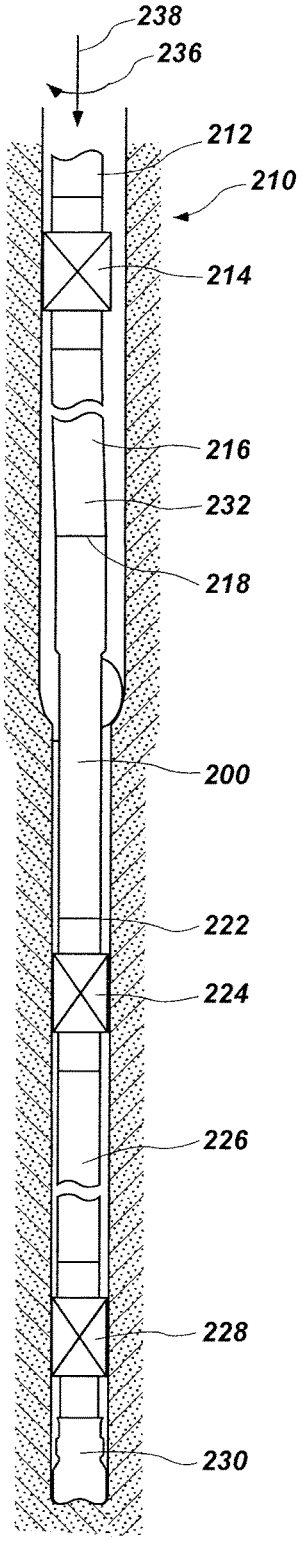

FIGS. 2A through 2C show a bi-center bottom-hole assembly 210 including a fixed-wing reamer 200. One or more drill collars 212 may be suspended from the distal end of a drill string extending to the rig floor at the surface. Pass through stabilizer 214 (optional) is secured to drill collar 212, the stabilizer 214 being sized equal to or slightly smaller than the pass through diameter of the bottom-hole assembly 210, which may be defined as the smallest diameter borehole through which the assembly may move longitudinally. Another drill collar 216 (or other drill string element such as a MWD tool housing or pony collar) is secured to the bottom of stabilizer 214, below which fixed-wing reamer 200 is secured via tool joint 218. Another joint 222 is located at the bottom of the fixed-wing reamer 200. Upper pilot stabilizer 224, secured to fixed-wing reamer 200, is of an O.D. equal to or slightly smaller than that of pilot bit 230 at the bottom of the bottom-hole assembly 210. Yet another, smaller diameter drill collar 226 is secured to the lower end of upper pilot stabilizer 224, followed by a lower pilot stabilizer 228 which is secured to the pilot bit 230. The pilot bit 230 may be either a rotary drag bit or a tri-cone, so-called "rock bit." The bottom-hole assembly 210 is by way of example only, and many other assemblies and variations may be employed. There is an upper lateral displacement between the axis of the pass through stabilizer 214 and the axis of the fixed-wing reamer 200, which displacement is provided by the presence of the drill collar 216 therebetween and which promotes passage of the bottom-hole assembly 210, and particularly the fixed-wing reamer 200, through a borehole segment of the design pass through diameter.

In pass through condition, shown in FIG. 2A, the assembly 210 is always in either tension or compression, depending upon the direction of travel, as shown by arrow 234. Contact of the bottom-hole assembly 210 with a borehole wall 250 is primarily through pass through stabilizer 214 and fixed-wing reamer 200. The bottom-hole assembly 210 is not normally rotated while in pass through condition.

FIG. 2B depicts the start-up condition of assembly 210, wherein assembly 210 is rotated by application of torque as shown by arrow 236 as weight-on-bit (WOB) is also applied to the string, as shown by arrow 238. As shown, pilot bit 230 has drilled ahead into the uncut formation to a depth approximating the position of upper pilot stabilizer 224, but fixed-wing reamer 200 has yet to commence enlarging the borehole to drill diameter. As shown at 232 and 240, the axis of the fixed-wing reamer 200 is laterally displaced from those of both pass through stabilizer 214 and upper pilot stabilizer 224. In this condition, the fixed-wing reamer 200 has not yet begun its transition from being centered about a pass through center line to its drilling mode center line which is aligned with that of pilot bit 230.

FIG. 2C shows the normal drilling mode of the bottom-hole assembly 210, wherein torque 236 and WOB 238 are applied. Upper displacement 232 may remain as shown, but generally is eliminated under all but the most severe drilling conditions. Lower displacement 240 has been eliminated as fixed-wing reamer 200 is rotating about the same axis as pilot bit 230 in cutting the borehole to full drill diameter.

Figure 3:
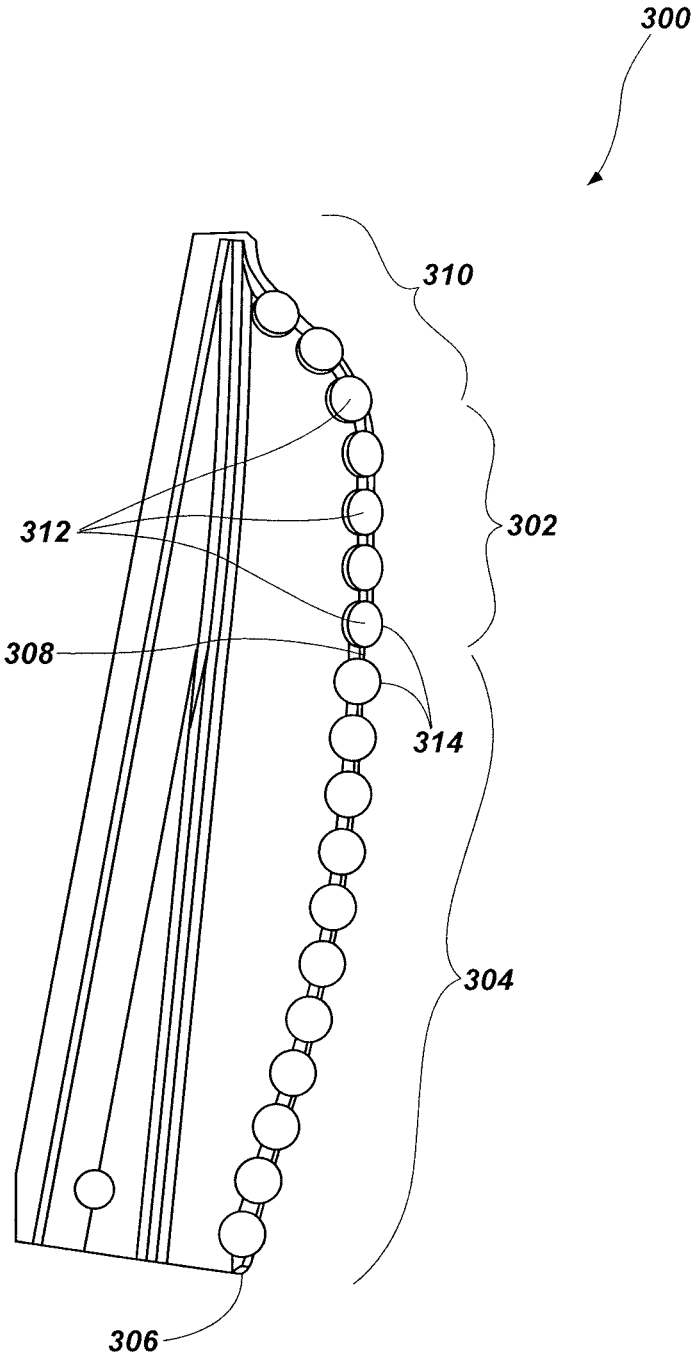
FIG. 3 is a perspective view of an embodiment of a blade of an expandable reamer.

With reference now to FIG. 3, a reamer blade 300 of an expandable reamer 100 (FIG. 1) is shown. While the reamer blade 300 is illustrated in connection with expandable reamer 100, aspects of the disclosure herein are equally applicable to expandable reamers and fixed-wing reamers of the type described in connection with FIGS. 2A through 2C. The reamer blade 300 may be configured to enlarge a borehole from an initial diameter to a larger, final diameter to enable subsequent operations (e.g., the installation of well bore casing or liner). For example, reamer blade 300 may include a profile with a gage portion 302, a downdrill shoulder portion 304 at a location distal to the gage portion 302, and an updrill shoulder portion 310 at a location proximal to the gage portion 302. A plurality of cutting elements 312 may be disposed in respective recesses (e.g., brazed into pockets) formed in each of the gage portion 302, the downdrill shoulder portion 304, and the updrill shoulder portion 310. The plurality of cutting elements 312 may engage the formation while the blade 300 is in an extended position, as described in connection with FIG. 1. The plurality of cutting elements 312 may each include a superabrasive material table and a supporting substrate. For example, the plurality of cutting elements 312 may include a polycrystalline diamond table affixed to a supporting substrate of tungsten carbide. The polycrystalline diamond table may be affixed to the supporting substrate during a manufacturing process such as a high-pressure high-temperature sintering process to form a polycrystalline diamond compact (PDC), or thereafter. In other embodiments, the plurality of cutting elements 312 may include cubic boron nitride, thermally stable polycrystalline diamond, or other materials suitable for shearing formation material.

The updrill shoulder portion 310 may be configured to, for example, ease removal of the expandable reamer 100 from the borehole or to enable the expandable reamer 100 to enlarge the borehole as the drill string and expandable reamer 100 are retracted from the borehole. The downdrill shoulder portion 304 may vary from a distal end 306 (i.e., an end farthest from the surface of the borehole) corresponding to an initial cutting diameter to a proximal end 308 corresponding to a larger, final or near-final cutting diameter substantially comprising a gage diameter of the enlarged borehole. As shown in FIG. 3, the downdrill shoulder portion 304 may include an arcuate profile between the distal end 306 and the gage portion 302. In other embodiments, the downdrill shoulder portion 304 may include a linear profile between the distal end 306 and the gage portion 302, or other shapes. The plurality of cutting elements 312 on the downdrill shoulder portion 304 may be positioned along an outer surface of reamer blade 300 to increase the diameter of a borehole from an initial diameter to a diameter equal to or nearly equal to a desired final diameter as the expandable reamer 100 (FIG. 1) rotates and advances through the formation.

A final cutting diameter and a finished surface of the borehole wall may be established by cutting edges 314 of at least one cutting element 312 located on the gage portion 302 of the reamer blade 300. The at least one cutting element 312 may include a superabrasive material, such as polycrystalline diamond, as described above in connection with the plurality of cutting elements 312. The cutting elements 312 may each comprise a substantially cylindrical shape with a cutting face diameter of, for example, 13 mm (0.51 inches), 16 mm (0.63 inches), or other sizes.

Because conventional drilling tools rotate as they advance through the formation, a cutting profile (i.e., a shape of the cutting edge 314) of the one or more cutting elements 312 attached to the gage portion 302 of the reamer tool 300 may leave a helical pattern in the borehole wall. For example, the cutting profile of a cylindrical cutting element may be defined by a portion of a periphery of the one or more cutting elements 312 in contact with the formation. As a result, a recess in the borehole wall corresponding to the cutting profile (i.e., a curved shape formed by the portion of the circumference) of the one or more cutting elements 312 may be formed along a helical pattern in the borehole wall as the expandable reamer 100 concurrently rotates and advances through the formation. Accordingly, hard or superabrasive material (e.g., PDC) of at least some of the cylindrical cutting elements 312 located in the gage portion 302 of the reamer blade 300 may conventionally be machined to include a planar surface oriented so that each cutting element includes a linear cutting edge oriented parallel to the longitudinal (i.e., rotational) axis of the expandable reamer 100 (FIG. 1). The linear cutting edge may provide a smoother borehole wall as the expandable reamer 100 advances through the formation, as the cutting profile engaged with the formation is linear and parallel to the direction in which the tool advances through the formation. The linear cutting edge may also reduce reactive torque from engagement of the formation material. Cutting elements including such a linear cutting edge may be referred to as "gage trimmers," and forming the planar surface may be referred to as "tip grinding."

Machining a planar surface into the cutting elements may compromise the structural integrity of the one or more cutting elements 312. For example, and as noted above, the cutting elements 312 may exhibit residual internal stresses resulting from the typically high processing temperatures and the potentially significant differences in thermal expansion between dissimilar materials in the cutting elements 312, such as diamond grains and metallic binder in the diamond table of a PDC. Residual stresses may also be present at the interface between the table of superabrasive material (e.g., polycrystalline diamond) and the supporting substrate of, for example, tungsten carbide, the magnitude, type and location of such stresses varying, depending upon interface configuration. The distribution of residual stress may be uniform or variable throughout each cutting element 312, depending on size and distribution of diamond particle feedstock used to form the polycrystalline diamond, concentration of diamond and catalyst, use of other additives and filler materials, etc. For example, residual stresses in a single cutting element 312 may increase or decrease uniformly as radial distance from a central axis of the cutting element 312 increases, or residual stress may vary between locations at the same radial distance from the central axis. Similarly, residual stresses may be constant or varying along lines parallel to a longitudinal axis of the cutting element 312. Removing material from the cutting element 312 by machining a planar surface may result in a modified stress distribution with higher and/or undesirable residual stresses in some regions. Such modified residual stresses may lead to accelerated wear or premature failure of the cutting elements 312 by, for example, spalling, delamination of the superabrasive table from the supporting substrate, or other failure mechanisms.

Conventionally, the planar surfaces are machined into the cutting elements 312 after the cutting elements have been affixed to a tool, for example, the expandable reamer blade 300. For example, machining to form the planar surfaces may take place after the cutting elements have been brazed into pockets of the reamer blade 300. Machining to form the planar surfaces may include, for example, grinding or milling. The cutting elements may be milled or ground until sufficient material has been removed to achieve the desired outside cutting diameter of the expandable reamer 100 (FIG. 1) with reamer blades 300 in an expanded position, and the desired borehole wall smoothness.

In some aspects of the present disclosure, the need for machining such planar surfaces to create a linear edge may be reduced or eliminated by altering the orientation of the cutting face of the at least one cutting element 312 disposed in the gage portion 302 of the expandable reamer blade 300.

Figure 4:
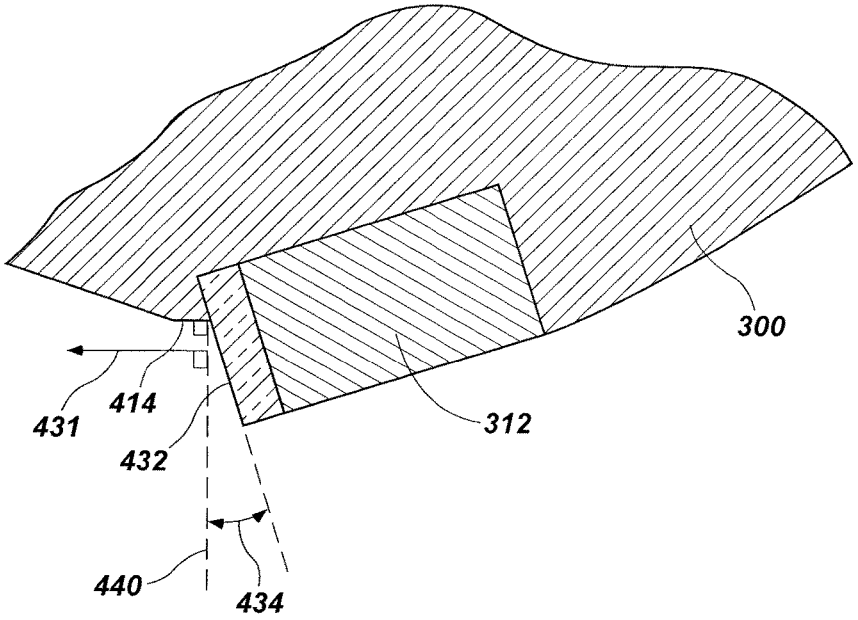
FIG. 4 is a cross-sectional view of a reamer blade and a cutting element according to the embodiment of FIG. 3.

For example, the orientation of the at least one cutting element 312 with respect to the blade 300 may be characterized at least partially by a cutting face back rake angle. FIG. 4 shows a cross-sectional view of a cutting element 312 positioned on the blade 300 of an expandable reamer 100 (FIG. 1). The instantaneous rotational cutting direction upon rotation of reamer 100 is represented by the directional arrow 431. The cutting element 312 may be mounted on the blade 300 in an orientation such that a cutting face 432 of the cutting element 312 is oriented at a back rake angle 434 with respect to a line 440. The line 440 may be defined as a line that extends (in the plane of FIG. 4) radially outward from an outer surface 414 of the blade 300 in a direction substantially perpendicular thereto at that location. Additionally or alternatively, the line 440 may be defined as a line that extends (in the plane of FIG. 4) radially outward from the outer surface 414 of the reamer blade 300 in a direction substantially perpendicular to the cutting direction as indicated by directional arrow 431. The back rake angle 434 may be measured relative to the line 440, positive angles being measured in the counter-clockwise direction, negative angles being measured in the clockwise direction.

Figure 5:
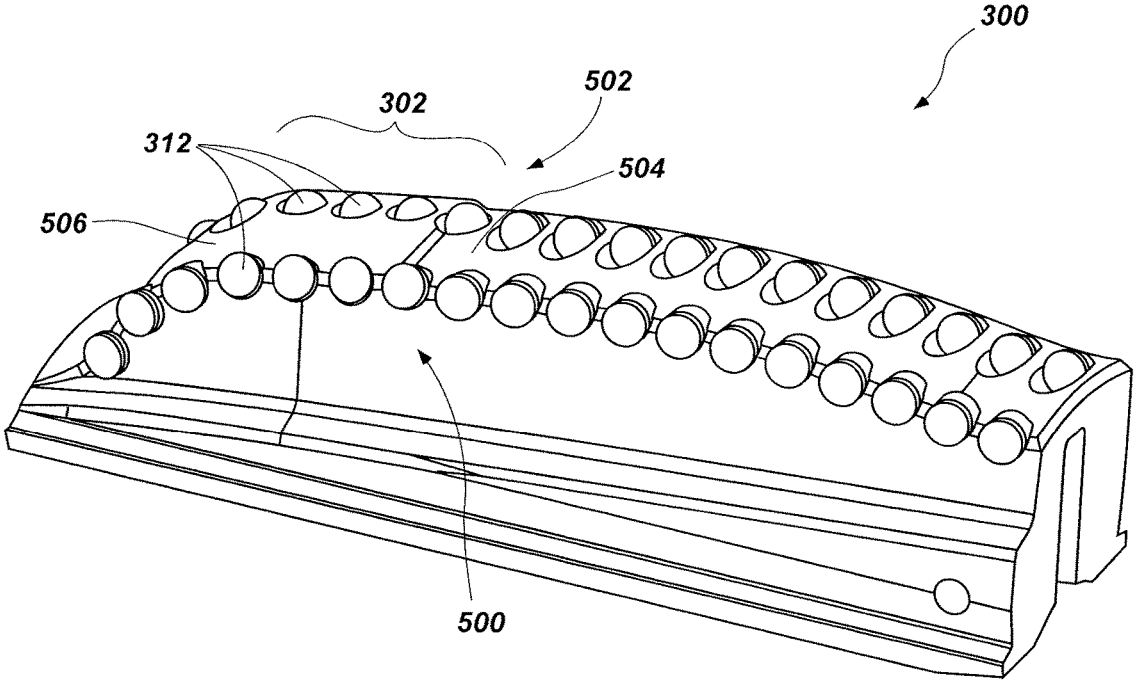
FIG. 5 is a perspective view of the reamer blade embodiment of FIG. 3.

With reference again to FIG. 3 and to FIG. 5, the gage portion 302 of the blade 300 of the expandable reamer 100 (FIG. 1) may include a plurality of cutting elements 312, for example, cylindrical PDCs, each of the plurality of cutting elements 312 exhibiting a cutting face back rake angle 434 (FIG. 4). The plurality of cutting elements 312 may be arranged in a single row, a double row as shown in FIG. 5, or other arrangements. The back rake angle of each cutting element 312 of the plurality of cutting elements 312 disposed on the gage portion 302 may be about 35° or more and less than about 75°. The back rake angles 434 of each of the plurality of cutting elements 312 disposed on the gage portion 302 may be substantially uniform (i.e., each of the plurality of cutting elements 312 disposed on the gage portion 302 may exhibit substantially the same back rake angle 434). For example, in one aspect of the disclosure, each of the plurality of cutting elements 312 disposed on the gage portion 302 may exhibit a back rake angle of about 60°.

In other aspects of the disclosure, each of the plurality of cutting elements 312 disposed on the gage portion 302 may include a different cutting face back rake angle 434. For example, the back rake angle of each of the plurality of cutting elements 312 disposed on the gage portion 302 may progressively increase from angles of about 35° near a distal end 504 of the gage portion 302 to about 75° near a proximal end 506 of the gage portion 302. Alternatively or additionally, the cutting face back rake angles of the plurality of cutting elements 312 disposed on the gage portion 302 may vary between discrete areas of the gage portion 302. For example, an area of the gage portion 302 between the distal end 504 and a midpoint of the gage portion 302 may include cutting elements with back rake angles of around 50°. Another area of the gage portion 302 between the midpoint and the proximal end 506 may include cutting elements with back rake angles of around 70°. Furthermore, the back rake angle 434 of each of the plurality of cutting elements 312 may vary between rows. For example, the cutting elements 312 disposed in a first row 500 of the gage portion 302 may include a first back rake angle, and the cutting elements 312 disposed in a second row 502 of the gage portion 302 may include a second, greater back rake angle. Alternatively, the back rake angles of cutting faces in both rows 500 and 502 may be substantially the same.

As back rake angle 434 (FIG. 4) of the cutting elements disposed on the gage portion 302 is increased, a contact area between the plurality of cutting elements 312 and the formation being cut may be reduced. Reducing the contact area between the plurality of cutting elements 312 and the formation may reduce the force required to move the plurality of cutting elements 312 through the formation as they engage the formation, thereby reducing the torque required to rotate the expandable reamer 100 and reactive torque experienced by the expandable reamer 100. Furthermore, a reduction in contact area between the plurality of cutting elements 312 and the formation reduces or eliminates the need for machining a linear edge into the cutting elements (i.e., tip grinding).

In addition to altering back rake angle 434, the need for tip grinding may also be reduced by varying the exposure of the plurality of cutting elements 312 disposed on the gage portion 302. Referring again to FIG. 4, the exposure of the cutting element 312 may be defined as a portion of the cutting face 432 that is exposed above the surface 414 of the blade 300 (FIG. 4). As shown in FIG. 4, a cutting element 312 affixed to reamer blade 300 may be oriented so that a portion of the cutting face 432 is located below the surface 414 of the blade 300. In one aspect of the disclosure, the cutting edge 436 of cutting element 312 may have an exposure of as much as one and a half (1.5) a radius of the cutting face 432 (i.e., the cutting element extends above the surface 414 of the blade 300 a distance greater than a radius of the cutting face 432), as shown in FIG. 4. In other aspects of the disclosure, the exposure of the cutting edge 436 of cutting element 312 may be about equal to the radius of the cutting face 432, or may be less than the radius of the cutting face 432. As the exposure of the cutting edge 436 of the cutting face 432 of the cutting element 312 decreases, contact area of the cutting element 312 with the formation also decreases. An exposure approximately equal to the radius of the cutting face 432, with an appropriate back rake of, for example, 60°, may provide a relatively small contact area with the formation for a given reamer diameter and reduce (e.g., eliminate) the need for tip grinding. In one aspect of the disclosure, a gage portion 302 of a reamer blade 300 (FIG. 5) includes a plurality of gage cutting elements 312 having a cutting edge 436 exposure of between 0.5 and 1.5 times the radius of the cutting element cutting face 432, and a back rake angle of between about 35° and about 70°. Each of the plurality of gage cutting elements 312 may include a different exposure, and the exposure of the plurality of gage cutting elements 312 may progressively decrease or increase along the gage portion 302 from the distal end 504 to the proximal end 506 (FIG. 5) or between the first and second rows 500 and 502 of the gage portion 302.

Additional, non-limiting embodiments within the scope of the present disclosure include, but are not limited to:

Embodiment 1

A downhole tool configured to enlarge a borehole, comprising at least one blade extending laterally from a central portion of the tool, the at least one blade comprising a gage portion, and cutting elements having substantially circular cutting faces affixed to the at least one blade, each of the cutting elements comprising a cutting edge for contacting the borehole, wherein cutting edges of at least one cutting element located on the gage portion are defined substantially by an arcuate portion of a cutting face periphery, the at least one cutting element located on the gage portion exhibiting a cutting face back rake angle greater than a back rake angle of cutting faces of cutting elements on at least one other portion of the at least one blade.

Embodiment 2

The downhole tool of embodiment 1, wherein the at least one cutting element exhibits a cutting face back rake angle of greater than about thirty-five (35) degrees.

Embodiment 3

The downhole tool of embodiments 1 or 2, wherein the at least one cutting element exhibits a cutting face back rake angle of less than about seventy-five (75) degrees.

Embodiment 4

The downhole tool of any one of embodiments 1 through 3, wherein the at least one cutting element located on the gage portion comprises a plurality of cutting elements, a cutting face of each cutting element exhibiting a different back rake angle, and wherein cutting face back rake angles of the plurality of cutting elements progressively increase from a distal end to a proximal end of the gage portion of the at least one blade.

Embodiment 5

The downhole tool of embodiment 4, wherein the cutting face back rake angles of the plurality of cutting elements progressively increase from about thirty-five (35) degrees to about seventy-five (75) degrees.

Embodiment 6

The downhole tool of any one of embodiments 1 through 5, wherein the at least one cutting element located on the gage portion comprises a plurality of cutting elements, each cutting element of the plurality of cutting elements exhibiting substantially the same back rake angle.

Embodiment 7

The downhole tool of embodiment 6, wherein a cutting face of each cutting element of the plurality of cutting elements exhibits a back rake angle of about fifty-five (55) degrees.

Embodiment 8

The downhole tool of any one of embodiments 1 through 7, wherein the cutting edge of the at least one cutting element extends above a surface of the at least one blade a distance about equal to or less than one and a half (1.5) times a radius of the cutting face of the at least one cutting element.

Embodiment 9

The downhole tool of embodiment 8, wherein the cutting edge of the at least one cutting element extends above the surface of the at least one blade a distance about equal to or less than the radius of the cutting face of the at least one cutting element.

Embodiment 10

The downhole tool of embodiment 8, wherein the cutting edge of the at least one cutting element extends above the surface of the at least one blade a distance about equal to or less than half (0.5 times) the radius of the at least one cutting element.

Embodiment 11

The downhole tool of any one of embodiments 1 through 10, wherein the downhole tool comprises an expandable reamer.

Embodiment 12

The downhole tool of embodiment 1 through 11, wherein the downhole tool comprises a fixed-wing reamer.

Embodiment 13

A reamer blade, comprising a gage portion, and cutting elements having substantially circular cutting faces affixed to the at least one blade, each of the cutting elements comprising a cutting edge for contacting the borehole, wherein cutting edges of at least one cutting element located on the gage portion are defined substantially by an arcuate portion of a cutting face periphery, the at least one cutting element located on the gage portion exhibiting a cutting face back rake angle greater than a back rake angle of cutting faces of cutting elements on at least one other portion of the at least one blade.

Embodiment 14

The reamer blade of embodiment 13, wherein the at least one cutting element exhibits a cutting face back rake angle of greater than about thirty-five (35) degrees.

Embodiment 15

The reamer blade of embodiments 13 or 14, wherein the at least one cutting element exhibits a cutting face back rake angle of less than about seventy-five (75) degrees.

Embodiment 16

The reamer blade of any one of embodiments 13 through 15, wherein the at least one cutting element located on the gage portion comprises a plurality of cutting elements, a cutting face of each cutting element exhibiting a different back rake angle, and wherein cutting face back rake angles of the plurality of cutting elements progressively increase from a distal end to a proximal end of the gage portion of the at least one blade.

Embodiment 17

The reamer blade of embodiment 16, wherein the cutting face back rake angles of the plurality of cutting elements progressively increase from about thirty-five (35) degrees to about seventy-five (75) degrees.

Embodiment 18

The reamer blade of embodiments 16 or 17, wherein the at least one cutting element located on the gage portion comprises a plurality of cutting elements, each cutting element of the plurality of cutting elements exhibiting substantially the same back rake angle.

Embodiment 19

The reamer blade of any one of embodiments 13 through 18, wherein the cutting edge of the at least one cutting element extends above a surface of the at least one blade a distance about equal to or less than a radius of the cutting face of the at least one cutting element.

Embodiment 20

The reamer blade of embodiment 19, wherein the cutting edge of the at least one cutting element extends above the surface of the at least one blade a distance about equal to or less than half (0.5 times) the radius of the at least one cutting element.

While certain illustrative embodiments have been described in connection with the figures, those of ordinary skill in the art will recognize and appreciate that the scope of this disclosure is not limited to those embodiments explicitly shown and described herein. Rather, many additions, deletions, and modifications to the embodiments described herein may be made to produce embodiments within the scope of this disclosure, such as those hereinafter claimed, including legal equivalents. In addition, features from one disclosed embodiment may be combined with features of another disclosed embodiment while still being within the scope of this disclosure, as contemplated by the inventors.

What is claimed is:

1. A downhole tool configured to enlarge a borehole, comprising:

at least one blade extending laterally from a central portion of the tool, the at least one blade comprising a gage portion; and cutting elements having substantially circular cutting faces affixed to the at least one blade, each of the cutting elements comprising a cutting edge for contacting the borehole, wherein a cutting edge of at least one cutting element located on the gage portion is defined substantially by an arcuate portion of a cutting face periphery, the at least one cutting element located on the gage portion exhibiting a cutting face back rake angle greater than a back rake angle of cutting faces of cutting elements on at least one other portion of the at least one blade, wherein the cutting edge of the at least one cutting element located on the gage portion extends above a surface of the at least one blade by a distance less than a radius of the cutting face of the at least one cutting element.

2. The downhole tool of claim 1, wherein the at least one cutting element exhibits a cutting face back rake angle of greater than about thirty-five (35) degrees.

3. The downhole tool of claim 1, wherein the at least one cutting element exhibits a cutting face back rake angle of less than about seventy-five (75) degrees.

4. The downhole tool of claim 1, wherein the at least one cutting element located on the gage portion comprises a plurality of cutting elements, a cutting face of each cutting element exhibiting a different back rake angle, and wherein cutting face back rake angles of the plurality of cutting elements progressively increase from a distal end to a proximal end of the gage portion of the at least one blade.

5. The downhole tool of claim 4, wherein the cutting face back rake angles of the plurality of cutting elements progressively increase from about thirty-five (35) degrees to about seventy-five (75) degrees.

6. The downhole tool of claim 1, wherein the at least one cutting element located on the gage portion comprises a plurality of cutting elements, each cutting element of the plurality of cutting elements exhibiting substantially the same back rake angle.

7. The downhole tool of claim 6, wherein a cutting face of each cutting element of the plurality of cutting elements exhibits a back rake angle of about sixty (60) degrees.

8. The downhole tool of claim 1, wherein the cutting edge of the at least one cutting element located on the gage portion extends above the surface of the at least one blade by a distance about equal to or less than half (0.5 times) the radius of the at least one cutting element.

9. The downhole tool of claim 1, wherein the downhole tool comprises an expandable reamer.

10. The downhole tool of claim 1, wherein the downhole tool comprises a fixed-wing reamer.

11. The downhole tool of claim 1, wherein the at least one cutting element located on the gage portion comprises a plurality of cutting elements located on the gage portion, and wherein a cutting edge of each cutting element of the plurality of cutting elements extends above the surface of the at least one blade by a different distance.

12. A reamer blade, comprising:

a gage portion; and cutting elements having substantially circular cutting faces affixed to the at least one blade, each of the cutting elements comprising a cutting edge for contacting the borehole, wherein a cutting edge of at least one cutting element located on the gage portion is defined substantially by an arcuate portion of a cutting face periphery, the at least one cutting element located on the gage portion exhibiting a cutting face back rake angle greater than a back rake angle of cutting faces of cutting elements on at least one other portion of the at least one blade, wherein the cutting edge of the at least one cutting element located on the gage portion extends above a surface of the at least one blade by a distance less than a radius of the cutting face of the at least one cutting element.

13. The reamer blade of claim 12, wherein the at least one cutting element exhibits a cutting face back rake angle of greater than about thirty-five (35) degrees.

14. The reamer blade of claim 12, wherein the at least one cutting element exhibits a cutting face back rake angle of less than about seventy-five (75) degrees.

15. The reamer blade of claim 12, wherein the at least one cutting element located on the gage portion comprises a plurality of cutting elements, a cutting face of each cutting element exhibiting a different back rake angle, and wherein cutting face back rake angles of the plurality of cutting elements progressively increase from a distal end to a proximal end of the gage portion of the at least one blade.

16. The reamer blade of claim 15, wherein the cutting face back rake angles of the plurality of cutting elements progressively increase from about thirty-five (35) degrees to about seventy-five (75) degrees.

17. The reamer blade of claim 15, wherein the at least one cutting element located on the gage portion comprises a plurality of cutting elements, each cutting element of the plurality of cutting elements exhibiting substantially the same back rake angle.

18. The reamer blade of claim 17, wherein a cutting face of each cutting element of the plurality of cutting elements exhibits a back rake angle of about sixty (60) degrees.

19. The reamer blade of claim 12, wherein the cutting edge of the at least one cutting element located on the gage portion extends above the surface of the at least one blade by a distance about equal to or less than half (0.5 times) the radius of the at least one cutting element.

20. The reamer blade of claim 12, wherein the at least one cutting element located on the gage portion comprises a plurality of cutting elements located on the gage portion, and wherein a cutting edge of each cutting element of the plurality of cutting elements extends above the surface of the at least one blade by a different distance.

* * * * *